United States Patent [19]

Czubernat et al.

[11] Patent Number: 4,653,833

[45] Date of Patent: Mar. 31, 1987

[54] RETRACTABLE BOOSTER CABLE DEVICE

[76] Inventors: Donald A. Czubernat, 6144 Chrismark Ave., San Diego, Calif. 92120; Alan C. Brozowski, 1296 Exeter St., El Cajon, Calif. 92021

[21] Appl. No.: 889,588

[22] Filed: Jul. 25, 1986

Related U.S. Application Data

[63] Continuation of Ser. No. 749,220, Jun. 27, 1985, abandoned.

[51] Int. Cl.[4] ..... H01R 13/627

[52] U.S. Cl. ..... 339/119 C; 191/12.4; 242/96; 339/29 B

[58] Field of Search ..... 339/119 C, 10, 29 B, 339/5 RL, 8 RL; 242/96, 107.11, 107.12, 107.13; 191/12.4

[56] References Cited

U.S. PATENT DOCUMENTS

| | | | |
|---|---|---|---|
| 2,501,740 | 7/1951 | Kennedy | 339/119 C |
| 4,390,142 | 6/1983 | Cheng | 242/96 |
| 4,466,581 | 8/1984 | Hill | 242/96 |

FOREIGN PATENT DOCUMENTS

| | | | |
|---|---|---|---|
| 677778 | 8/1952 | United Kingdom | 242/107.12 |

*Primary Examiner*—Eugene F. Desmond

*Attorney, Agent, or Firm*—Frank D. Gilliam

[57] ABSTRACT

A retractable booster cable device comprising a container which rotatably supports a spool by means of two spool end walls. The spool is divided into two substantially equal portions by means of a divider wall intermediate the end walls. A twin element cable passes through the hollow center of the spool, extends through each spool portion and exits the container through exits on each end thereof. The cable is centered so that substantial equal lengths extend from both exits. A deployed cable is stowed by rotating the spool in a first direction. The cable is deployed from a stowed position by simultaneously pulling both ends of the cable from the container causing the spool to rotate in a second direction. Clips are provided to removeably attach the ends of the cables to the container.

11 Claims, 3 Drawing Figures

RETRACTABLE BOOSTER CABLE DEVICE

This application is a continuation of application Ser. No. 749,220, filed June 27, 1985, now abandoned.

BACKGROUND OF THE INVENTION

The invention relates to a retractable cable device, and more particularly, this invention relates to a combined battery booster cable and storage container device from which the booster cable can be deployed when stored in the container for and restored in the container after use.

Cable devices, known generally as "booster cables" for use in supplying power to the battery of one vehicle from the battery of another vehicle, have long been employed. The specific purpose of these cables is to obtain sufficient additional electrical power from the battery of one vehicle to the starter and ignition circuits of a second vehicle with insufficient battery power due to a run down or dead battery. In the simplest and most common form these cable devices are comprised of a pair of heavy duty cables of large gauge wire with some form of clamps or attachment means at each end so that the proper battery terminals of each vehicle battery may be interconnected. Generally, the person using such cable devices carries them in his vehicle. The individual cables are usually in excess of ten feet in length and invariably present an annoying storage problem. Since the cables are long and stiff they are not easily compacted into a neat and orderly arrangement either by winding into a series of loops or winding into a ball or simply by being compacted into a random, unwound package. Furthermore, in use, the individual cables are necessarily extended to their full length before being used regardless of the distance between the two batteries to be interconnected.

There have been attempts made to design cable devices for various purposes in which a scheme is taught for neat and orderly storage of the cables. One of these devices is described in U.S. Pat. No. 3,853,285 issued on Dec. 10, 1974 to Horace Leo Woodring.

The Woodring device is a retractable cable device which comprises a cable used as a booster cable for vehicle batteries which is wound around a spring loaded spool positioned within a container in a manner so that the ends of the cable pair are accessible at separate container exits. The cable is wound around the spool in a double manner. The cable is first looped in a crimped fashion and the loop is secured to the spool with the cable doubly wound around the spool so that each end of the cable exits the container on opposite sides thereof. The spool is biased in the cable wound position and stop means are provided so that the spool may be stopped at a selected cable length from maximum length to minimum length. An end clamp storage means is provided. The above reference patent provides an improvement to the prior art use of a pair of ten to fifteen feet long cables as described above. However, the device of the patent has several drawbacks and a device with a further advancement to overcome these drawbacks would be more readily acceptable.

SUMMARY OF THE INVENTION

Therefore, the primary object of this invention is to further advance the art directed to vehicle booster cables and storage means for booster cables that is non-complex in construction and simple to operate.

Another object of the invention is to provide a combination carrier and booster cables wherein the continuous cable is fed through the carrier in a manner that does not require any crimping, severe doubling back one on the other or bending of the cable pairs.

Still another object of the invention is to provide a carrier in which a battery booster cable can be contained which does not require a complicated spring and ratchet mechanism for deployment and storage.

Still another object of the invention is to provide a carrier for containing a battery booster cable wherein a failed booster cable can be readily replaced.

These and other objects of the invention will become apparent from the accompanying drawings which describe the invention as a spool on which the center of a booster cable pair is secured and wound upon when stowed, a container with large side openings which the end walls of the spool partially penetrate and are rotatable relative thereto, a knob attached to one spool end wall for rotating the spool and end walls, a divider wall intermediate the spool end walls and attached thereto bisects the upper winding surface of the spool, openings are located on each end of the carrier from which each end of the booster cable exits the adjacent bisected portion of the spool and clip means attached to the carrier end surfaces for securing the battery connector clamp ends of the booster cable to the carrier for storage, the cable is deployed from the spool at a desired length by simultaneously pulling the cables from the carrier. To again stow the cables in the carrier, the knob is grasped and the spool and walls are rotated in a direction which again winds the cables back onto the spool in a fully stowed position.

DESCRIPTION OF THE PREFERRED EMBODIMENT

Figure 1:
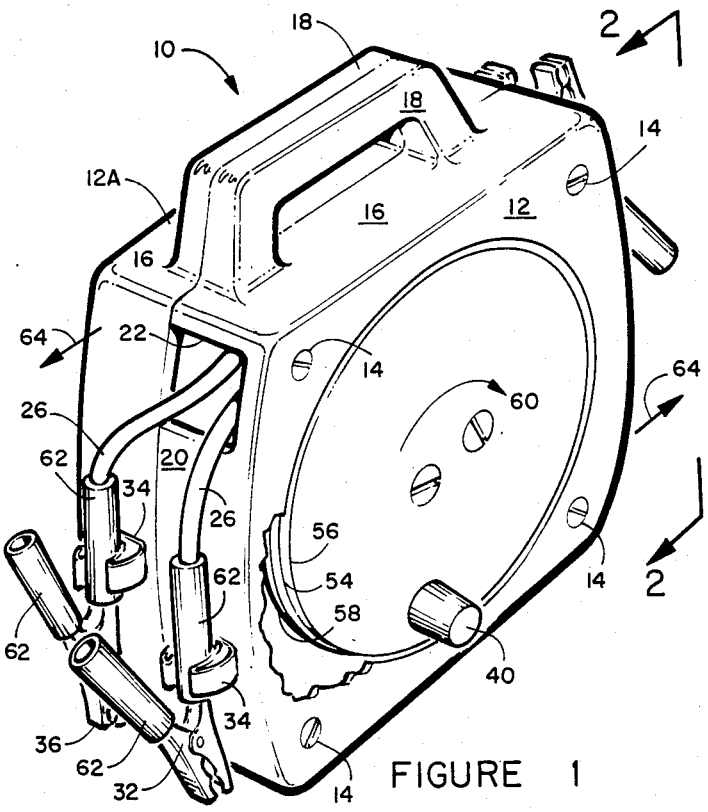
FIG. 1 is a perspective elevated view of the combined carrier and booster cable combination of the invention.
Figure 2:
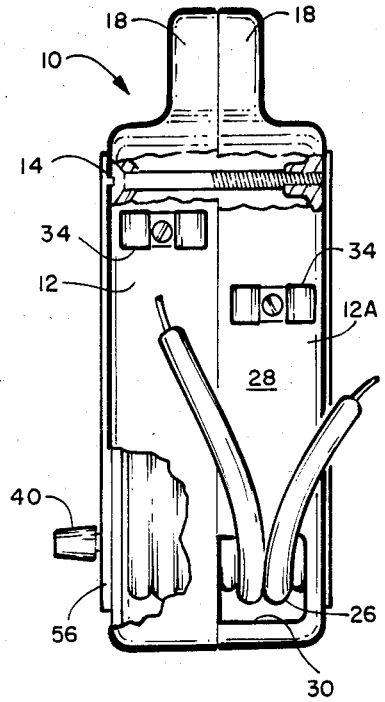
FIG. 2 is an end view of FIG. 1 partially cut away to show the engagement of the spool to the carrier and the attachment of the carrier housing halves.

FIGS. 1 and 2 show a retractable cable device 10. The device includes a pair of carrier housing halves 12 and 12A which are interconnected to form the carrier by means of screws 14 or the like. The upper surface 16 of the halves include a half handle 18 which when positioned together provide a handle for ease of carrying the device. As shown, the upper end wall 20 of halve 12 includes a slot 22 on its upper surface near the handle half for the passing that of booster cable 26 exterior of the carrier. End wall 28 of half 12A includes a slot 30 at the lower end of the wall remote from the handle half for the same purpose as slot 22.

Each end of the two stranded booster cable 26 include battery terminal attachment clamps 32, shown as alligator type clips. Any convenient type of battery attachment may be used to practice the invention.

A pair of spring clips 34 on end walls 20 and 28 hold the attachment clamps in place when the booster cables are not in use.

Figure 3:
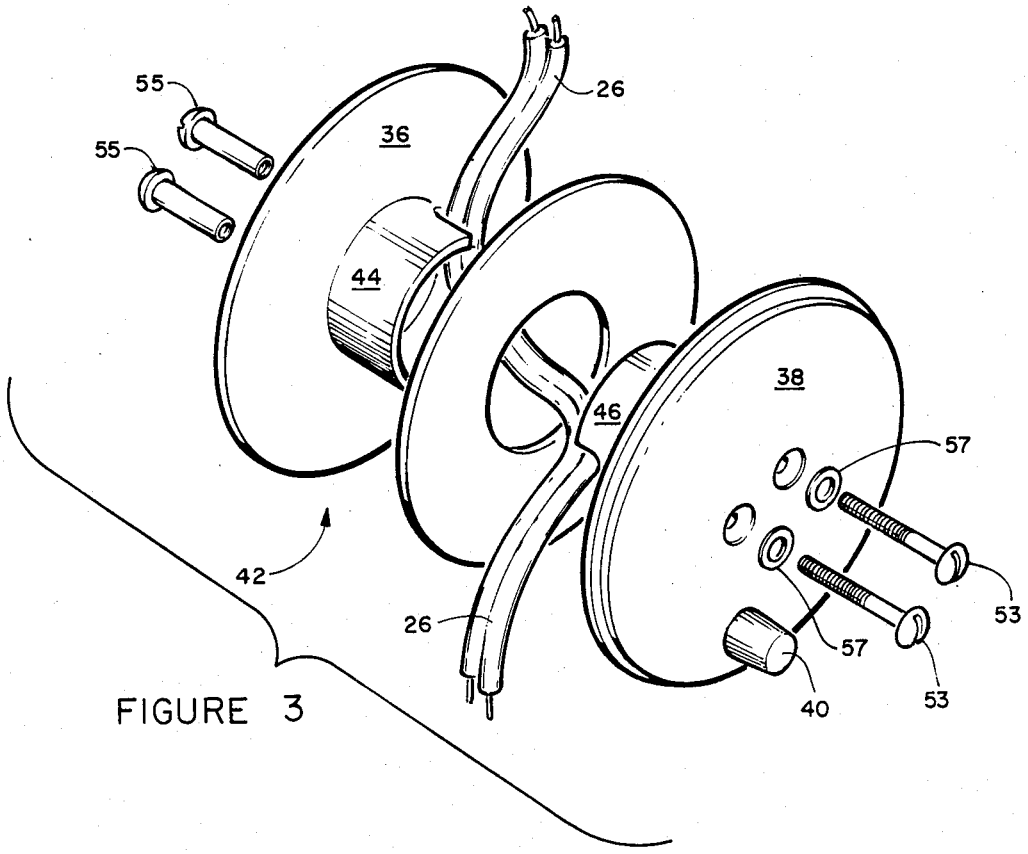
FIG. 3 is an exploded showing of the booster cable spool.

Referring now to FIG. 3, the booster cable receiving spool is hollow and includes a pair of end walls 36 and 38. End wall 38 includes a knob 40 used to rotate the receiving spool for cable retraction and storage.

The receiving spool surface 42 is formed by two spool halves 44 and 46 and a central wall 52. Each spool half includes a slot 48 through its surface. In assembly of the device 10, the booster cable is passed through one slot 48 through the opening 50 of a diameter slightly less than the diameter of the hollow portion of the core halves in a central wall 52 and out the other slot 48. The spool halves and central wall are then joined by a pair of male threaded bolts 53 mating with a pair of female threaded bolts 55 with washer means 57 extending through the end walls and hollow spool portions to form an integral unit. A light adhesive may be used between the spool half and the central wall.

Each carrier half side wall includes a central circular opening 54 therethrough. An outer edge 56 of the end walls extend through the openings 54. An inner lip 58 extends from the edge 56 and forms a surface of a diameter greater than the outer edge 56.

When the two carrier halves 12 and 12A are assembled as shown in FIGS. 1 and 2, the inner lip 58 bears against the inner surface of the adjacent housing halves thereby retaining the spool assembly within the carrier and allows for relative rotation thereto when deploying or stowing the booster cable on the spool receiving surfaces. Obviously, the spool, when assembled, is dimensioned so that it will be maintained between the carrier openings 54.

The carrier and spool assembly are constructed of materials such as plastics, or the like so that the components are inexpensive and can be injection molded or the like and which provide a lubricious surface between the rotatable spool assembly and the carrier contacting surfaces.

Conventional battery booster cables can be employed and generally include metal clamps 38 with electrical insulation 62 thereon for short circuit prevention.

It should be understood that if booster cable failure occurs that the carrier can be disassembled by screw removal and a new cable can be installed with very little effort.

The operation of the combined carrier and booster cable should be obvious so only a short explanation follows.

As shown in FIGS. 1 and 2, the cable has been wound onto the carrier spool either in assembly or by the rotation of knob 40 in the direction of arrow head 60. The battery clamps are stored in the spring clips and the device is storeable for further use.

For use, the clamps are removed from the clips and the cable ends are simultaneously pulled outward in the direction of arrow head 64 until the desired length span between the cable ends is obtained. The booster cable is then used in a conventional and known manner. In this manner, the excess booster cable length remains stowed and out of the way. To again fully stow the booster cable, knob 40 is grasped and the spool assembly is rotated in the direction of arrow head 60 until the cable length exposed is as shown in FIG. 1. The clamps are again clipped to the carrier and the carrier and cable can again be stored for future use.

It should be clear that the present invention is well adapted to carry out the objects and attain the ends and advantages mentioned as well as those inherent therein. While a presently preferred embodiment of the invention has been described for the purposes of this disclosure, numerous changes may be made which will readily suggest themselves to those skilled in the art and which one encompassed within the spirit of the invention disclosed and is defined in the appended claims.

What is claimed is:

1. A battery booster cable dispensing device comprising:

a container with circular openings on each side thereof and battery booster cable exits on opposite ends thereof;

a tubular spool of uniform end to end diameter with a circular divider wall intermediate the ends thereof and a pair of openings through the spool surface to the hollow tubular portion, one of said pair on each side of said divider wall;

a pair of outer spool circular end walls with substantially the same circumference as said circular divider wall fixedly attached to the distal ends of said spool and mounted in said container with each end wall partially through one of the circular side openings for relative rotation therewith;

a twin element cable, said cable passes through the tubular hollow portion of said spool longitudinally with each end extending through one of said pairs of openings through said spool surface on each side of said divider wall and extending from said container through one of said exits, a portion of said cable is wound on each side of said divider wall by rotating said spool relative to said housing in a first direction;

spring loaded clamps connected to each end of each element of said twin element cable; and externally extending U shaped clips connected at their closed end surface to the outer surface of said container adjacent to said exits, one of said U shaped clips positioned on each side of said divider wall for removably attaching said clamps to said container.

2. The invention as defined in claim 1 wherein one of said end walls includes a knob attached thereto at a location spaced from the center of said one of said end walls.

3. The invention as defined in claim 1 wherein a substantially equal length of said twin element cable extends from each of said cable exits.

4. The invention as defined in claim 1 wherein each of said exits is aligned with said spool surface on different sides of said divider wall.

5. The invention as defined in claim 1 wherein said twin element cable is unwound from said spool by simultaneously pulling the ends of said cable outwardly from said container.

6. The invention as defined in claim 1 wherein said spool surface is formed by two spool halves interconnected with said circular divider wall interposed between said halves, said circular divider wall having a central aperture, with a diameter slightly less than the diameter of the hollow portion of said spool halves.

7. The invention as defined in claim 6 wherein each of said spool halves includes an open notch abutting said circular divider wall for forming said pair of openings through the spool surface.

8. The invention as defined in claim 6 wherein said circular divider wall is adhered to said spool halves.

9. The invention as defined in claim 1 wherein said booster cable exits are substantially perpendicular to said twin element cable positioned between said spool and said exits.

10. The invention as defined in claim 1 wherein said container and end walls are formed of lubricious material.

11. The invention as defined in claim 10 wherein said lubricious material is plastic.

* * * * *